US005854457A

United States Patent [19]

Nishikawa

[11] Patent Number: 5,854,457

[45] Date of Patent: Dec. 29, 1998

[54] TILTING ON-OFF SWITCH

[76] Inventor: Kikuyoshi Nishikawa, 17, Tsuokacho, Asahi-ku, Yokohama-shi, Kanagawa, Japan

[21] Appl. No.: 971,680

[22] Filed: Nov. 17, 1997

[51] Int. Cl.[6] ..... H01H 35/02

[52] U.S. Cl. ..... 200/61.51; 200/61.52; 200/DIG. 8

[58] Field of Search ..... 200/61.52, 52 A, 200/DIG. 8, DIG. 9, 61.45 R, 61.48, 61.51

[56] References Cited

U.S. PATENT DOCUMENTS

| | | | |
|---|---|---|---|
| 1,445,706 | 2/1923 | Papini | 200/61.52 X |
| 2,064,827 | 12/1936 | Gardner | 200/61.51 |
| 2,252,358 | 8/1941 | Tosi | 200/61.52 X |
| 3,778,572 | 12/1973 | Matsui et al. | 200/61.52 X |
| 4,916,266 | 4/1990 | Tetrault | 200/61.51 X |
| 5,153,394 | 10/1992 | Abendroth et al. | 200/61.52 |

*Primary Examiner*—Renee S. Luebke

[57] ABSTRACT

A tilting ON-OFF switch is made up of a pair of fixed contact pieces placed on the bottom of a columnar cavity defined by a housing and a cap and spaced a predetermined distance apart in the circumferential direction, a movable contact piece having plural tongues radially extending therefrom at a pitch smaller than a spreading angle of a fan-shaped or sectorial area of each of the fixed contact pieces for contact therewith, and a movable truncated-conical weight in the housing attached coaxially to the movable contact piece.

10 Claims, 6 Drawing Sheets

TILTING ON-OFF SWITCH

BACKGROUND OF THE INVENTION

The present invention relates to a tilting ON-OFF switch that can be used, for example, as an image sensing prohibitive mechanism when a portable TV camera overturns, or as a switch for detecting overturning of an electric heater.

In FIGS. 1 and 2 there is shown the structure of a conventional tilting ON-OFF switch. Reference numeral 10 denotes a switch housing, which is a tubular molding of an insulating resin. The housing 10 has a bottom frame 10A and has its upper opening covered with a cap 2, defining a cavity or hollow space 3 in the housing by the cap 2 and the bottom frame 10A. In this example, the housing 10 is cylindrical and has an O ring 4 inserted between its outer peripheral surface and the cap 2 to hermetically seal the cavity 3.

The housing 10 has a pair of diametrically opposed fixed contact pieces 5 and 6 inserted in and molded integrally with the housing side wall 10B. The fixed contact pieces 5 and 6 are disposed near the bottom frame 10A but partly exposed in the cavity 3 so that a steel ball contacts the exposed portions, thereby establishing electric connections between the fixed contact pieces 5 and 6.

Reference numerals 5A and 5B denote terminals leading to the fixed contact pieces 5 and 6, respectively.

With such an arrangement, while the housing is in an upward position, the steel ball 7 remains in contact with the fixed contact pieces 5 and 6 to hold them in conduction. When the housing 10 is tilted, the steel ball 7 moves or rolls out of contact with the fixed contact piece 5 or 6 to such a position as indicated by the one-dot-chain line in FIG. 1. As a result, the terminals 5*a* and 6A are electrically disconnected and an OFF signal is issued. Sometimes, there also arises a situation where the housing 10 is normally downward or horizontally oriented, in which case an OFF signal is issued at all times but when the housing 10 assumes an upward position, an ON signal is generated.

As depicted in FIG. 2, the fixed contact pieces 5 and 6 have their inner central portions cut out into semicircular-arc-shaped marginal edges M for contact with the spherical surface of the steel ball 7. With this structure, when the switch housing 10 is tilted in the directions indicated by the arrows J and K in FIG. 2, the steel ball 7 moves or rolls while remaining in contact with both of the terminals 5A and 6A. Consequently, no contact-OFF signal can be issued even though the housing 10 is tilted.

SUMMARY OF THE INVENTION

It is therefore an object of the present invention to provide a tilting ON-OFF switch which permits generation of a contact signal no matter in which direction the switch is tilted over the entire angular range of 360 degrees.

The ON-OFF switch according to the present invention is made up of a pair of fixed contact pieces placed on the bottom of a columnar cavity defined by a housing and a cap and spaced a predetermined distance apart in the circumferential direction, a movable contact piece having plural tongues radially extending therefrom at a pitch smaller than the open angle of fan-shaped areas of said pair of contact pieces for contact therewith, and a truncated-conical weight mounted in the housing coaxially with the movable contact piece.

With such a structure, when the housing tilts, the truncated-conical weight tumbles in the cavity. By this tumbling of the weight, the movable contact piece tilts with two tongues at the fulcrum, while the other tongues float up off the bottom of the cavity. By selecting the space between two tongues to be smaller than the space between the opposed fixed contact pieces the movable contact piece surely gets out of contact with one of the fixed contact pieces, ensuring the generation of a contact OFF signal.

In the tilting ON-OFF switch, a stepped portion may be formed in the inner surface of the cylindrical housing near the lower end of the cavity for engagement with the marginal portion of the lower end face of the weight. When the weight tilts, the marginal portion of its lower end face bumps on the stepped potion, by which the movable contact piece floats up off the fixed contact pieces, and hence it is disconnected therefrom.

DETAILED DESCRIPTION OF THE PREFERRED EMBODIMENTS

Figure 1:
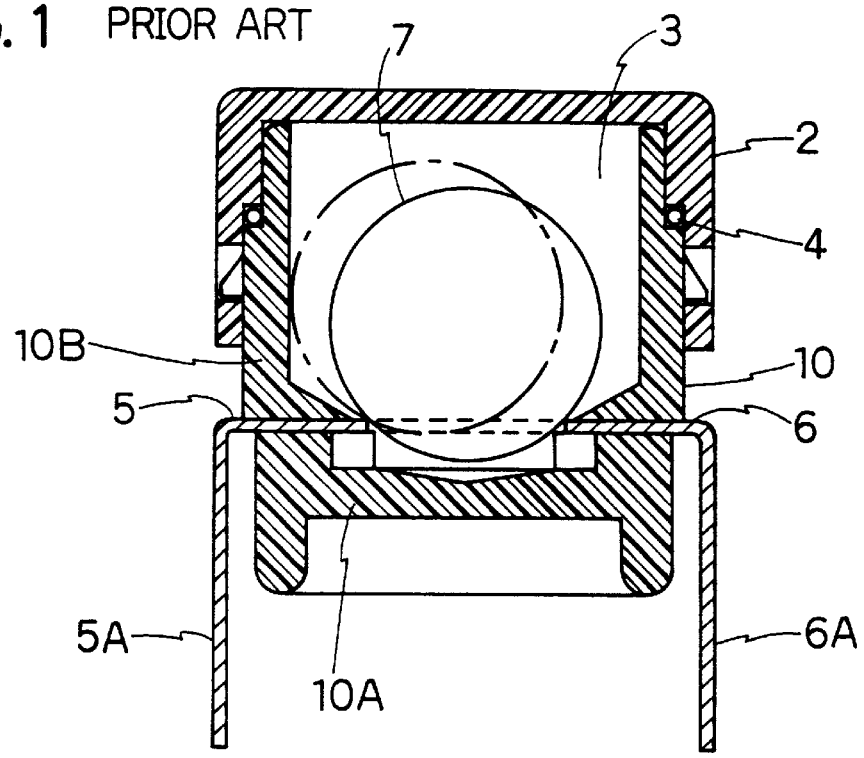
FIG. 1 PRIOR ART
FIG. 1 is a sectional view for explaining the prior art.
Figure 2:
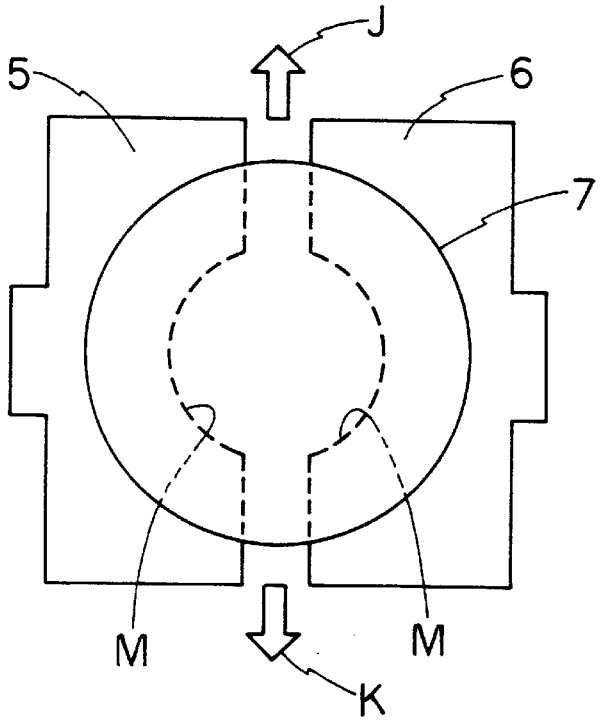
FIG. 2 PRIOR ART
FIG. 2 is a plan view for explaining the relationships between fixed contact pieces and a movable contact piece in FIG. 1.
Figure 3:
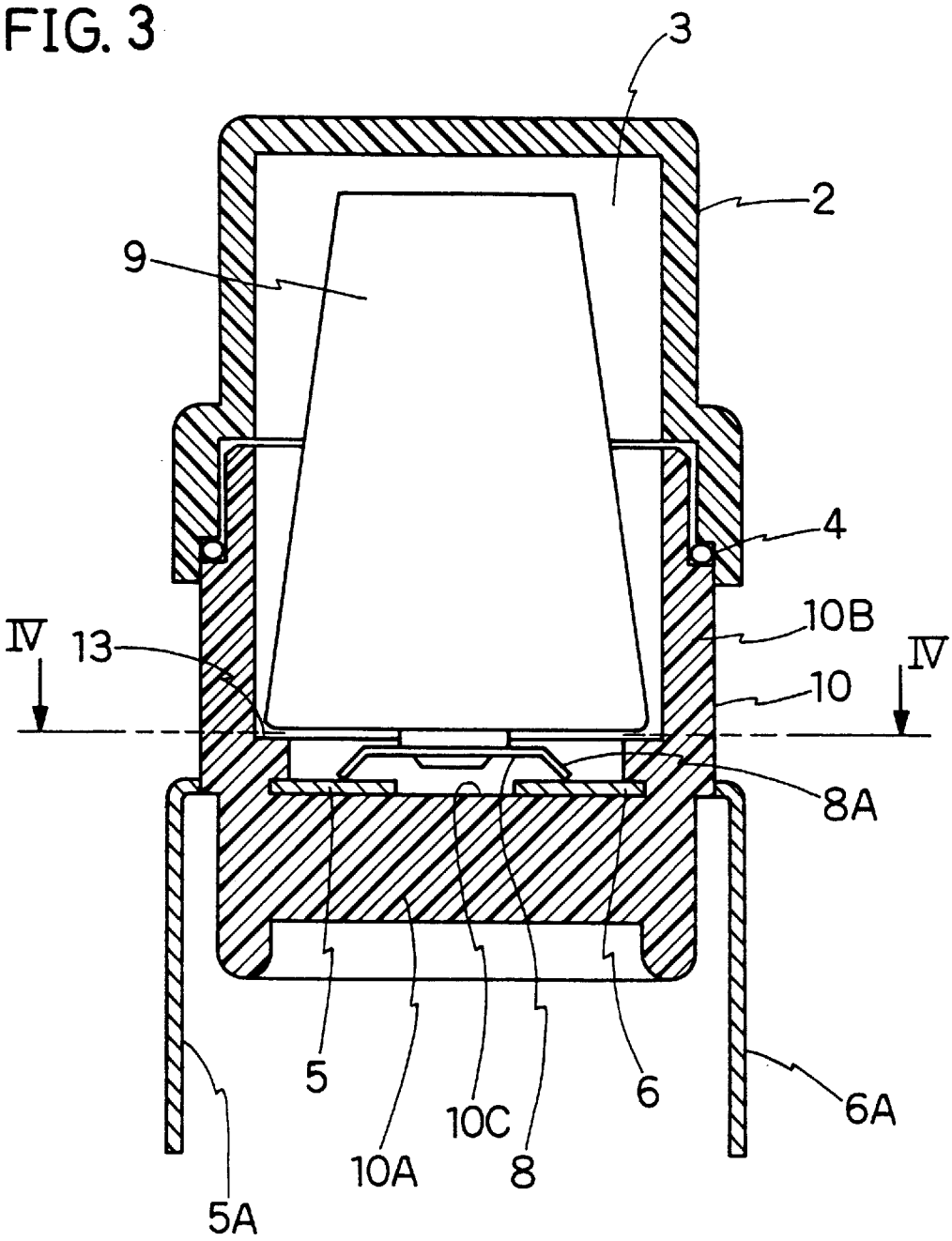
FIG. 3 is a vertical sectional view illustrating an embodiment of the present invention.

In FIG. 3 there is illustrated an embodiment of the present invention. Reference numeral 10 denotes a housing composed of a bottom frame 10A and a cylindrical side wall 10B molded integrally from an insulating material, and 2 denotes a cap similarly formed of an insulating material, for covering the upper open end portion of the housing 10. The housing 10 and the cap 2 are made cylindrical, defining therein a columnar cavity or hollow space 3. Interposed between the cap 2 and the housing 10 is an O ring 4 that provides a hermetically-sealed structure for the cavity 3.

On the bottom frame 10A in the cavity 3 there are exposed a pair of fixed contact pieces 5 and 6, which are extended through the side wall 10B in diametrically opposite directions to form terminals 5A and 6A. The switch is mounted on a printed-circuit board with the terminals 5A and 6A bent downward. The structure described so far is the same as in the prior art.

Figure 4:
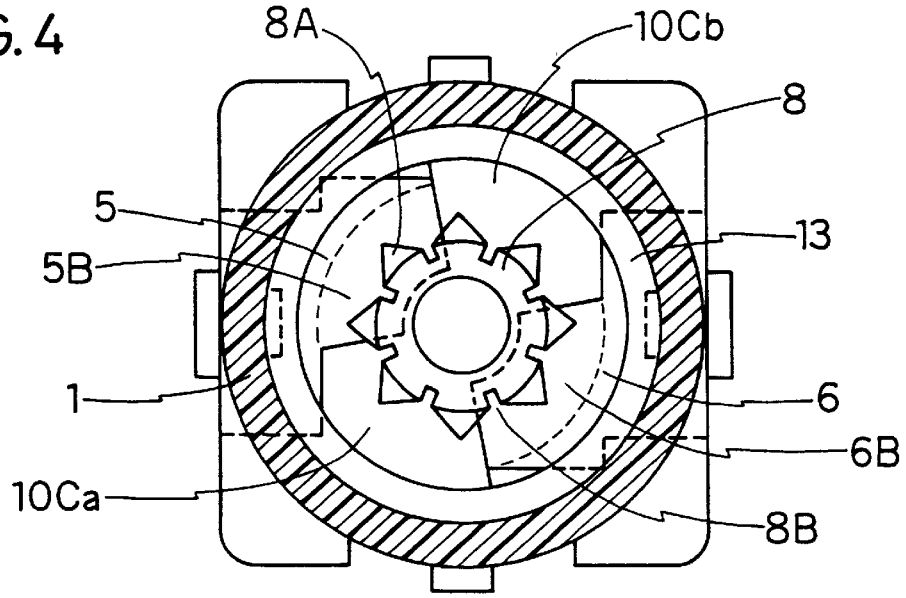
FIG. 4 is plan view of the FIG. 3 embodiment with a cap and a weight taken off.
Figure 5:
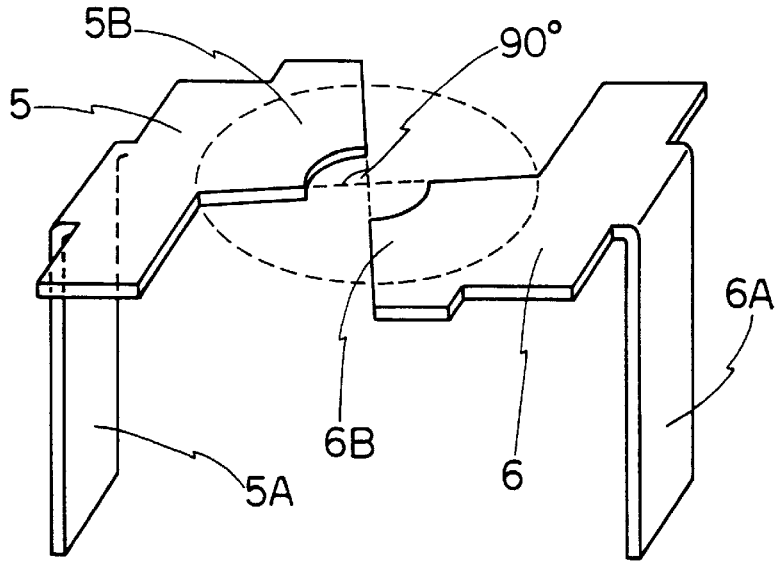
FIG. 5 is a perspective view showing a pair of fixed contact pieces.

As shown in FIGS. 4 and 5, the fixed contact pieces 5 and 6 made of sheet metal have quarter-circle (90°) fan-shaped or sectorial areas 5B and 6B. In this embodiment, the fixed contact pieces 5 and 6 are insert-molded as one piece so that they are concentrically disposed on the frame surface 10C at a 90° angular distance. Accordingly, the top surfaces of the contact pieces 5 and 6 are higher than the frame surface 10C by their thickness and exposed areas 10Ca and 10Cb of the frame surface 10C between the fixed contact pieces 5 and 6 are also fan-shaped spreading over 90 degrees.

Figure 6:
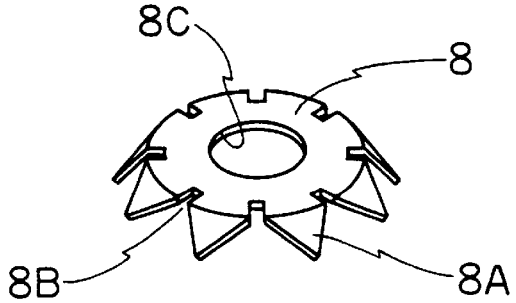
FIG. 6 is a perspective view showing a movable contact piece.

A movable contact piece 8 has, as shown in FIGS. 4 and 6, tongues 8A extending radially from the peripheral edge of a circular sheet metal and separated by grooves 8B cut in the peripheral edge thereof at equiangular intervals. These tongues 8A are bent down about 45 degrees on the same circumference, each bent portion forming a triangle with its tip as the vertex. The angular distance between the tongues 8A disposed on the same circle is selected smaller than the spread angle of the fan-shaped or sectorial area of each fixed contact piece, and the circle along which the tips of the tongues 8A are arranged is positioned concentrically with the circular area containing the fan-shaped areas 5B and 6B. This ensures that while the switch is not tilted, the tips of at least two tongues 8A of the movable contact piece 8 rest on the fan-shaped areas 5A and 6B of the fixed contact pieces 5 and 6. In practice, a weight 9 is hardly supported at four or more points but mostly at three points because of the accuracy of the circle of arrangement of the tongues 8A and the flatness accuracy of the fan-shaped areas 5B and 6B—this does not present any problems in the turn-OFF movement of the switch when it overturns. The movable contact piece 8 has a centrally-disposed hole 8C, through which it is fixed by a rivet or screw to the center of the underside of the weight 9. The diameter of the circle along which the tips of the tongues 8A are arranged is selected smaller than the maximum diameter of the truncated-conical weight 9.

As shown in FIG. 3, the weight 9 is in the form of a truncated cone whose diameter gradually decreases upward so that it can be tilted in the cavity 3. The diameter of the lower end portion of the weight 9 is close to the inner diameter of the cavity 3. In the inner wall surface of the lower end portion of the cavity 3 over the entire circumference thereof there is formed a stepped portion 13 which has its annular step extended in the same plane perpendicular to the axis of the cylindrical housing 10. When the weight 9 stands still on the movable contact piece 8, the annular step of the stepped potion 13 and the underside of the weight 9 are opposed to but spaced apart from each other. Accordingly, the step of the stepped portion 13 is set at a position higher than the fixed contact pieces 5 and 6 but lower than the marginal edge of the lower end face of the weight 9.

Figure 7:
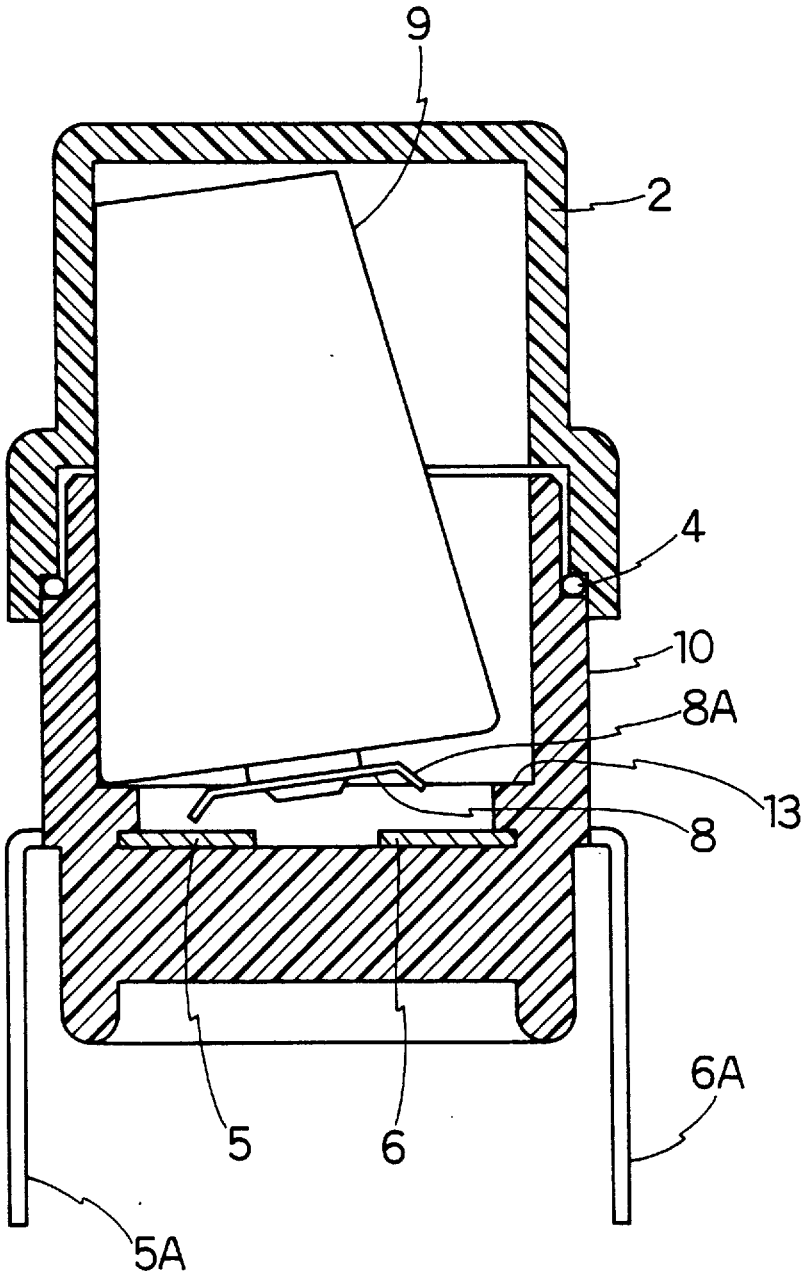
FIG. 7 is a vertical sectional view showing the state in which the weight has tumbled in the FIG. 3 embodiment.

With the structure described above, when the housing 10 tilts instantaneously, the weight 9 tumbles in the cavity 3 with respect to the housing 10 as shown in FIG. 7 and part of the outer peripheral edge of the lower end face of the weight 9 bumps on the stepped portion 13, while at the same time the tongues 8A of the movable contact piece 8 float up off the top surfaces of the fixed contact pieces 5 and 6 at least for a moment. The height of the stepped portion 13 is fixed along the entire circumference of the housing 10; hence, when the weight 9 tilts in excess of a fixed value in any direction, the movable contact piece 8 floats up, destroying the electric connections between the terminals 5A and 6A at least for a moment. This disconnection need not be continued; only an instantaneous interruption is enough. In the case where the height of the stepped potion 13 is lower than the height from the underside of the weight 9 to the underside of the movable contact piece 8, either one of the fixed contact pieces 5 and 6 and two tongues 8A of the movable contact piece 8 remain in contact with each other even when the weight 9 tumbles, but the other fixed contact piece and the movable contact piece 8 stay out of contact with each other. That is, whenever the weight 9 tilts, the movable contact piece 8 surely goes out of contact with at least one of the fixed contact pieces 5 and 6 regardless of the direction of tilt, issuing a contact OFF signal.

Figure 8:
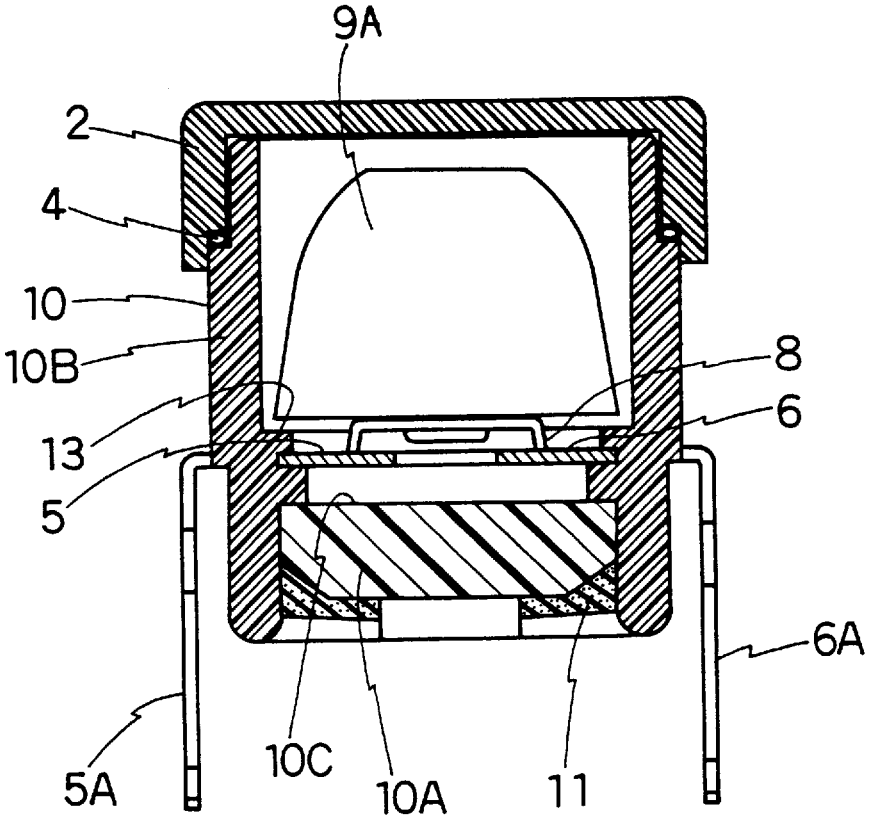
FIG. 8 is a vertical sectional view illustrating another embodiment of the present invention.

FIG. 8 illustrates a modified form of the embodiment described above with respect to FIGS. 3 through 7. In the above embodiment the fixed contact pieces 5 and 6 are shown to be placed on the panel surface 10C in the cavity 3, but if the fixed contact pieces 5 and 6 are thick enough to such an extent as not to be deformed by the weight 9A, they may be fixedly supported at a position higher than the panel surface 10C in the cavity 3 as shown in FIG. 8. The weight 9A need not always be in the truncated-conical form but may be in any other form as long as the diameter decreases upward as depicted in FIG. 8. In the embodiment of FIG. 8, it is also possible to mold the housing 10 substantially cylindrical in shape and insert a plug as the bottom panel 10A into the bottom opening and sealed using an adhesive 11. This is intended to allow ease in supporting the fixed contact pieces 5 and 6 when they are molded integrally with the housing 10.

Figure 9:
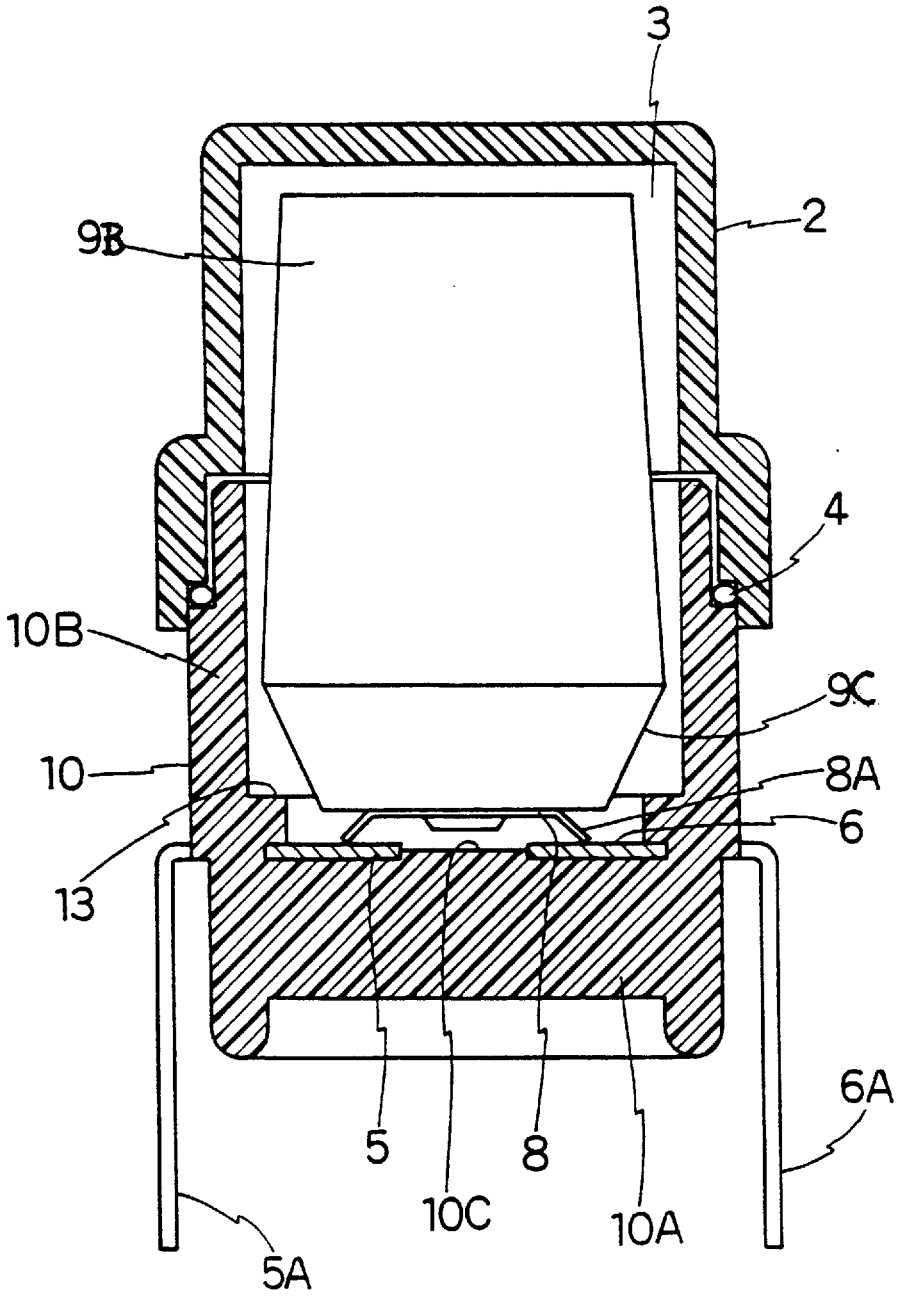
FIG. 9 is a sectional view showing a modified form of the present invention.

Alternatively, as depicted in FIG. 9, the fixed contact pieces 5 and 6 may be embedded in the bottom panel 10A with the top surfaces of the contact pieces slightly above or flush with the panel surface 10C in the cavity 3. In such an instance, the movable contact piece 8 is formed of elastic sheet metal to ensure contact between it and the weight 9B so that the fixed contact pieces 5 and 6 and the tongues 8A of the movable contact piece 8 are surely held in contact with each other at all times. By this, the movable contact piece 8 attached to the weight 9B can be supported by the fixed contact pieces 5 and 6 at four or more points, and consequently, even if the movable contact piece 8 gets in touch with the insulator surface forming the panel surface 10C in the cavity 3, the two metallic fixed contact pieces 5 and 6 can be held in contact with the movable contact piece 8.

In the two embodiments described above, since the stepped portion 13 is formed in the inner wall of the housing 10 near the lower end of the cavity 3 so that the underside of the weight 9A or 9B bumps onto the stepped portion 13, the weight turns or swivels with the stepped portion 13 as the fulcrum. Hence, when the weight 9A or 9B tilts and overturns, its underside floats up over the entire area thereof. As the result of this, the movable contact piece 8 also moves up as a whole—this also ensures the generation of the contact OFF signal.

While the above embodiments each have the construction in which when part of the lower marginal portion of the weight bumps onto the stepped potion 13 formed in the inner surface of the housing 10, the movable contact piece 8 moves up off the fixed contact pieces 5 and 6, thereby electrically disconnecting the terminals 5A and 6A from each other, it is also possible to employ a construction in which at least one of the fixed contact pieces 5 and 6 is brought out of contact with the movable contact piece 8 by mere tilting of the weight, destroying the electric connection between the terminals 5A and 6A. This will be described below with reference to FIG. 9.

As depicted in FIG. 9, the lower end portion of the weight 9B is tapered downward as indicated by 9C to prevent the lower end from bumping onto the stepped portion 13. The stepped portion 13 makes the housing 10 thick and increases the strength with which to hold the fixed contact pieces 5 and 6 by insert molding. This goes for the embodiments described above. In the FIG. 9 embodiment, the underside of each of the fixed contact pieces 5 and 6 is held flush with or slightly lower than the bottom of the cavity 3, but the top of each fixed contact piece is held flush with or higher than the bottom of the cavity. Preferably the movable contact piece 8 is formed of elastic sheet metal so that it is slightly bent by the weight 9B to ensure contact between the movable contact piece 8 and the top surfaces of the fixed contact pieces 5 and 6 while the switch is in normal orientation. This embodiment is identical in construction with the FIG. 3 embodiment except for the above.

EFFECT OF THE INVENTION

As described above, according to the present invention, the specific shapes of the movable contact piece 8 and the fixed contact pieces 5 and 6 ensure the generation of a contact OFF signal no matter in which direction the weight tilts over the entire angular range of 360 degrees in the horizontal plane. Accordingly, the present invention offers highly reliable tilting ON-OFF switch, and the formation of the stepped portion 13 further enhances the reliability.

It will be apparent that many modifications and variations may be effected without departing from the scope of the novel concepts of the present invention.

What is claimed is:

1. A tilting ON-OFF switch for detecting overturning, comprising:

a cylindrical housing containing a cylindrical side wall and a bottom frame closing a lower end of said cylindrical side wall to define a columnar cavity in the housing;

a pair of fixed contact pieces located in a lower end portion of said cavity in a plane perpendicular to a center axis of said cavity and opposed from one another across said axis, said pair of fixed contact pieces respectively having portions that extend through said cylindrical side wall of said housing to form terminals exterior to said housing;

a weight movably received on said pair of fixed contact pieces in said cavity, said weight having a substantially truncated-conical portion whose diameter gradually decreases in an upward direction; and a movable contact piece formed of sheet metal, said movable contact piece being fixed to an underside of said weight concentrically therewith and extending over said pair of fixed contact pieces, said movable contact piece having plural tongues arranged along a circle of a diameter smaller than a maximum diameter of said weight and bent downward, tips of said tongues being arranged along a circle having a diameter smaller than said maximum diameter of said weight.

2. The switch of claim 1, wherein each of said pair of fixed contact pieces has a fan-shaped area of a fixed spreading angle, said fan shaped areas of said contact pieces being spaced from one another at a fixed angular distance, adjacent ones of said tongues being angularly spaced from one another by an angular amount smaller than the spreading angle of each of said fan-shaped areas.

3. The switch of claim 2, wherein each of said fan-shaped areas has a 90° spreading angle.

4. The switch of claim 1, 2, or 3, wherein said pair of fixed contact pieces are placed on said bottom frame.

5. The switch of claim 4, wherein top surfaces of said pair of contact pieces are higher than a top surface of said bottom frame.

6. The switch of claim 4, wherein said pair of fixed contact pieces are embedded in said bottom frame with top surfaces of said fixed contact pieces being substantially flush with a top of said bottom frame, said movable contact piece being formed of elastic sheet metal.

7. The switch of claim 2 or 3, wherein an annular stepped portion is formed in an inner surface of said cylindrical side wall, said stepped portion having a top face that is higher than upper surfaces of said pair of fixed contact pieces but lower than said underside of said weight so that, when said weight stands upright, a marginal portion of said underside of said weight is opposite to but spaced apart from said annular stepped portion.

8. The switch of claim 7, wherein a lower end portion of said weight is tapered so that its diameter gradually decreases in a downward direction.

9. The switch of claim 1, 2, or 3, wherein said bottom frame is inserted in said housing from said lower end of said cylindrical side wall so that said bottom frame lies in opposed but spaced relation to said pair of fixed contact pieces to serve as a plug closing a lower end of said housing.

10. The switch of claim 1, 2, or 3, wherein said housing includes a cap mounted on a top end of said cylindrical side wall to close an upper end of said housing.

* * * * *